US011219810B2

(12) United States Patent
Gray

(10) Patent No.: US 11,219,810 B2
(45) Date of Patent: Jan. 11, 2022

(54) TACKLE TRAINING APPARATUS

(71) Applicant: Richard John Gray, Galashiels (GB)

(72) Inventor: Richard John Gray, Galashiels (GB)

( * ) Notice: Subject to any disclaimer, the term of this patent is extended or adjusted under 35 U.S.C. 154(b) by 0 days.

(21) Appl. No.: 16/666,467

(22) Filed: Oct. 29, 2019

(65) Prior Publication Data

US 2020/0129832 A1 Apr. 30, 2020

(30) Foreign Application Priority Data

Oct. 31, 2018 (GB) ..... 1817841

(51) Int. Cl.
*A63B 69/34* (2006.01)

(52) U.S. Cl.
CPC .... *A63B 69/345* (2013.01); *A63B 2243/0066* (2013.01)

(58) Field of Classification Search
CPC ..... A63B 69/345; A63B 2243/0066; A63B 69/201; A63B 69/34; A63B 69/0071
USPC ..... 473/450, 458, 438, 442–446; 482/83–90
See application file for complete search history.

(56) References Cited

U.S. PATENT DOCUMENTS 130,068 A * 7/1872 Parent ..... A63H 3/46 446/380
419,285 A * 1/1890 Sanborn ..... A63B 69/208 482/90
604,243 A * 5/1898 Verpillier et al. ..... A63H 3/46 446/375
704,265 A * 7/1902 McMaster ..... A63B 69/345 473/442
1,007,628 A * 10/1911 Armstrong ..... A63B 69/208 482/85
1,176,730 A * 3/1916 Ashton ..... A63B 69/201 473/443
1,204,017 A * 11/1916 Hinkley ..... A63B 69/345 473/442
1,544,110 A * 6/1925 Stall ..... A63B 69/345 473/444
1,544,693 A * 7/1925 Snyder ..... A63B 69/345 473/442
1,622,691 A * 3/1927 Warner ..... A63B 69/345 473/442
1,663,659 A * 3/1928 Ridgeway ..... A63B 69/345 473/444

(Continued)

FOREIGN PATENT DOCUMENTS

FR 2582529 A1 * 12/1986 ..... A63B 69/34

*Primary Examiner* — Mitra Aryanpour
(74) *Attorney, Agent, or Firm* — Blue Filament Law PLLC

(57) ABSTRACT

A tackle training apparatus includes a padded body member and two padded elongate leg members in which each leg member has a first end for abutting the body member and a second end for contacting the ground. The two leg members are arranged in relation to the body member to extend from and to be resiliently movable relative to and/or separable from the body member, and in one configuration where the second end of each of the two leg members is placed on the ground, the two leg members can support the body member such that the apparatus is in a standing position, provides an effective training apparatus for improvements in collisions and especially tackles in rugby. Use of the apparatus facilitates improvement in point of contact, height of approach, grip technique and grip strength.

20 Claims, 2 Drawing Sheets

(56) References Cited

U.S. PATENT DOCUMENTS 1,906,693 A * 5/1933 Loughlin ..... A63B 69/345 473/442
3,010,253 A * 11/1961 Ostrander ..... A63H 3/46 446/380
3,277,602 A * 10/1966 Speers ..... A63H 3/46 446/380
3,361,310 A * 1/1968 Ziegler ..... A47F 8/00 446/376
3,634,966 A * 1/1972 Ostrander ..... A63H 3/46 446/380
3,861,676 A * 1/1975 Paul ..... A63B 69/34 482/83
3,907,291 A * 9/1975 Parker ..... A63B 69/345 473/445
4,088,315 A * 5/1978 Schemmel ..... G06F 19/3481 482/4
4,534,557 A * 8/1985 Bigelow ..... A63B 43/00 473/441
4,688,792 A * 8/1987 Rivkin ..... A63B 69/345 473/443
4,989,862 A * 2/1991 Curtis ..... A63B 69/0071 446/326
5,280,905 A * 1/1994 Micco ..... A63B 69/345 473/444
5,527,185 A * 6/1996 Davis ..... A63B 69/34 434/247
5,772,538 A * 6/1998 Sztykiel ..... A63B 63/00 473/446
5,928,093 A * 7/1999 Lai ..... A63B 69/34 473/430
6,348,028 B1 * 2/2002 Cragg ..... A63B 69/201 434/248
7,131,917 B2 * 11/2006 Spencer ..... A63B 21/0058 473/444
7,147,579 B2 * 12/2006 Forrest ..... A63B 69/345 473/441
8,052,582 B2 * 11/2011 Summers ..... A63B 69/34 473/441
9,931,555 B1 * 4/2018 McCoy ..... A63B 69/0071 473/450
9,968,838 B2 * 5/2018 Daniels ..... G06K 9/00342 482/82
2007/0099730 A1 * 5/2007 Driver ..... A63B 69/345 473/422
2007/0225089 A1 * 9/2007 Jones ..... A63B 69/34 473/447
2011/0256990 A1 * 10/2011 Machado ..... A63B 69/345 482/83
2014/0378281 A1 * 12/2014 Mazi ..... A63B 69/34 482/83

* cited by examiner

TACKLE TRAINING APPARATUS

FIELD OF THE INVENTION

This invention pertains generally to the field of sports training equipment and in particular to articles and apparatus to facilitate training in the tackle and collision area of rugby and other sports. More particularly, the invention relates to a tackle training apparatus, to a method of training and to a method of manufacture.

BACKGROUND OF THE INVENTION

Aids to facilitate tackling and the collision area of sports, such as the game of rugby, exist in the form of tackle bags of cylindrical form which may stand on the ground, optionally supported by a coach, for use by someone training in the sport to tackle, in the form of collision shields fitted with straps to be held by a coach and tackled by someone training in the sport.

A disadvantage of the existing art is that the articles are limited in their function. Other more sophisticated apparatus is available in the form of steel frame devices with padded portions for particular training exercises. These typically have a disadvantage in terms of cost to purchase but also limited functionality.

The present inventor has invented a new training device for use in rugby, American Football or other collision sport training.

Problem to be Solved by the Invention

There is a need for improvements in sports training devices which improve the versatility and specificity of rugby training articles for the tackle.

It is an object of this invention to provide an article for facilitating tackle training technique in rugby, American Football and other contact sports that is versatile, low-cost, improves safety, is efficient to manufacture and adaptable for use in a range of training exercises for technique in the tackle.

SUMMARY OF THE INVENTION

In accordance with a first aspect of the invention, there is provided a tackle training apparatus comprising:

a padded body member; and two padded elongate leg members, each leg member having a first end for abutting the body member and a second end for contacting the ground, wherein the two leg members are arranged in relation to the body member to extend from and to be resiliently movable relative to and/or separable from the body member.

Preferably, in one configuration where the second end of each of the two leg members is placed on the ground, the two leg members can support the body member such that the apparatus is in a standing position.

In a second aspect of the invention, there is provided a method of manufacturing an apparatus as defined in any one of the preceding claims comprising forming a body member of foam material and covering it with an outer protective coating or covering, forming two thigh members or leg members of foam material and covering them with an outer protective coating or covering, and providing to the body member and thigh or leg members a biasing means for biasing a first end of each leg member toward intimate contact with the body member.

In a third aspect of the invention, there is provided a method of training in contact sports such as rugby, the method comprising providing an apparatus as defined above and conducting training exercises on the apparatus in tackling technique.

Advantages of the Invention

The sports training apparatus of the invention provides an effective training apparatus for improvements in collisions and especially tackles in rugby. Use of the apparatus facilitates improvement in point of contact, height of approach, grip technique and grip strength, for example.

DETAILED DESCRIPTION OF THE INVENTION

Figure 1:
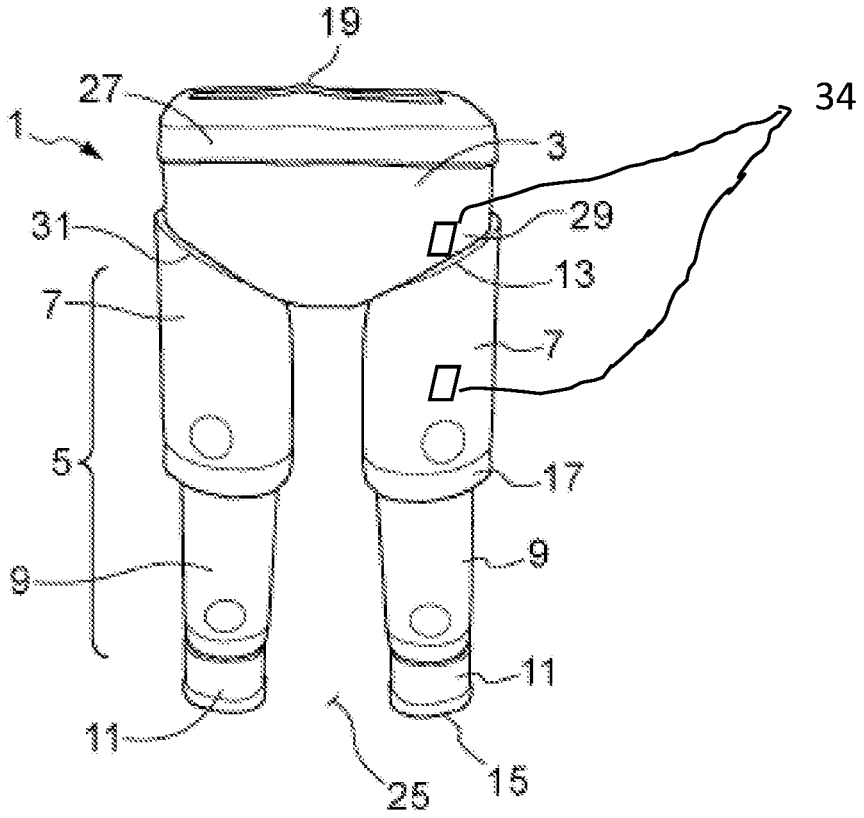
FIG. 1 illustrates in front view of an apparatus according to one embodiment of the invention.

The training apparatus according to the invention is for use in tackle training and preferably for use in collision training for rugby or American football, such as a tackle in rugby. However, it can be used in training any tackle, collision and grip maneuver in a contact sport.

The tackle training apparatus comprises a padded body member and two padded elongate legs or leg members, each leg member having a first end for abutting the body member and a second end for contacting the ground. The two leg members are arranged in relation to the body member so as to extend from and be resiliently moveable relative to and/or separable from the body member. Preferably, in one configuration in which the second end of each of the leg members is place on or in contact with the ground, the two leg members may be configured to support the body member (e.g. by placing in an upright orientation and disposing the body member in contact with the first ends of the leg members) in a standing position.

Preferably, the leg members are resiliently separable from the body member. For example, the leg members may be pulled from the body member and when released are caused to return to contact (in a resting configuration) with the body member or re-orientated relative to the body member so as to dispose the leg member in a second configuration relative to the body member and when released is caused to return to its first (resting) orientation relative to the body member.

The apparatus preferably comprises a biasing means for biasing the first end of each leg member toward intimate contact with the body member and/or to a resting configuration relative to the body member.

The biasing means may be any suitable means that causes this resilience.

Preferably, the biasing means comprises an elastic material configured to link each leg member or a first end of each leg member to the body member. The biasing means may comprise, for example, an elastic covering which covers both the body member and the leg members and draws them together in a particular and preferred resting configuration in which the leg members are in contact with a leg-contacting surface of the body member. The biasing means may comprise, for example, a resilient or elasticated member or material disposed between the first end of each leg member and the body member and may be attached to the first end of each leg member and the body member (e.g. a leg-contacting surface of the body member). The biasing means may preferably comprise an elastic material which extends through at least a portion of the leg member, preferably through the first end, and is preferably anchored in or to the leg member. Preferably the biasing means also extends through at least a portion of the body member, preferably through a leg-contacting surface of the body member.

The elastic material may comprise an elastic band or a bungee, for example. Preferably, the apparatus comprises an elastic material in the form of a band or bungee that extends through a first end of a first leg and into the interior of the first leg and preferably through the first leg and preferably through a corresponding leg-contacting surface in the body member. Preferably the elastic band or bungee extends through a first end of a second leg and into the interior of the second leg and preferably through the second leg and preferably through a corresponding leg-contacting surface in the body member.

In one embodiment, the biasing means comprises two elastic bands or bungees: a first elastic band or bungee extending through a first end of a first leg and through at least a portion of the first leg (preferably through the first leg and anchored at a second end thereof) and through a first leg-contacting surface of the body member for cooperating with the first end of the first leg and into and through at least a portion the body member (preferably through the body member and anchored at a top surface thereof, e.g. beneath an outer coating); and a second elastic band or bungee extending through a first end of a second leg and through at least a portion of the second leg (preferably through the second leg and anchored at a second end thereof) and through a second leg-contacting surface of the body member for cooperating with the first end of the second leg and into and through at least a portion the body member (preferably through the body member and anchored at a top surface thereof, e.g. beneath an outer coating).

In another embodiment, the biasing means comprises a single elastic band which extends into and is anchored in each of the legs as described in relation to the above embodiment, but which extends into and through the body member from a first leg-contacting surface to and out through a second leg-contacting surface. The path through the body member may be close to the bottom of the body member, through a medial portion or close to the top or exits the top and re-enters the top of the body member.

In further embodiment, the biasing means comprises a single elastic band or bungee, but in a loop whereby two strands of the elastic band or bungee pass through a first leg from an anchor position in relation to the first leg (e.g. at a second end thereof) and out of a first end thereof, into the body member via a first leg contacting surface, through the body member and out a second leg contacting surface, through the first end of the second leg, through the second leg to an anchor position in relation to the second leg (e.g. at a second end thereof).

The two legs are preferably disposed in relation to opposing lateral portions of the body member, preferably separated by at least one third of a width of a leg member.

The body member may be any suitable shape, but is preferably has a shape that can be supported by two legs. Preferably, the body member is a pelvis body member.

A pelvis body member may be a cube or cuboid or is a prism, e.g. a triangular, pentagonal or hexagonal prism, and is preferably in the form of a pentagonal prism, which is preferably configured such that an end of the prism forms a pentagonal front face of the pelvis body. The pelvis body member preferably has a pelvis top surface, which preferably extends the full lateral extent (or most of the lateral extent) of the pelvis body member and is preferably flat (e.g. horizontal when the apparatus is in a standing position). A handle may be provided on the top surface of the pelvis body member 3.

Preferably, the body member comprises two leg-contacting surfaces. The leg-contacting surfaces may be horizontal when the apparatus (and body member) are in an upright configuration. In one embodiment, when in an upright configuration, the leg-contacting surfaces are disposed at an angle to the horizontal, preferably from 25° to 45°, more preferably from 30° to 40°.

The body member preferably has one or more of the following dimensions: a width of from 20 to 60 cm, a height (top to bottom) of from 15 to 50 cm and a depth (front to back) of form 15 to 50 cm.

Preferably each leg member comprises a thigh member and a lower leg member.

Preferably a thigh member has a first end for cooperation with the body member, e.g. a leg-contacting surface of the body member. A first end of a thigh member may, when disposed in an upright position, be horizontal. Preferably a first end of a thigh member defines a planar surface disposed at an angle to the horizontal (when in an upright position), preferably from 25 to 45° and more preferably 30 to 40°. By providing a cooperating plane between a first end of a thigh member and a leg-contacting surface of a body member that is disposed at an angle to the horizontal, when in an upright position, the leg is capable of moving back and fore relative to the body member about an axis perpendicular to the cooperating plane, thus effectively defining a hip joint.

In another embodiment, the cooperating surfaces of the leg and the body member define a ball and socket joint.

Preferably, a thigh member has a second end for cooperating with a lower leg member at a first end thereof. Preferably the second end of the thigh member and the first end of the lower leg member are planar surfaces that are disposed at a common angle and together form a cooperating plane. The second end of the thigh member may, when in an upright position, define a horizontal planar surface or an angle thereto of from 5 to 45°, e.g. 10 to 30°, such as 15 to 20°. Preferably the second end of the thigh member is horizontal or within 5° thereof. Preferably the first end of the lower leg member defines a surface for cooperating with the second end of the thigh member and preferably is planar and defines a common angle with that of the second end of the thigh member.

In another embodiment, the cooperating surfaces of the thigh member and the lower leg member define a ball and socket joint.

A thigh member and a lower leg member may be of any suitable shape or configuration but preferably configured so that the lower leg member may support the thigh member when the apparatus is in a standing position. A thigh member and a lower leg member are preferably elongate members. They may have a constant width along their lengths or may be variable, such as reducing in width from one end toward the other (e.g. a cone, truncated cone, pyramid or truncated pyramid) or having a widest point in a mid-portion of the length thereof. Preferably, one or other or both of the thigh member and lower leg member are prismic, such as triangular prisms, square prisms, pentagonal prisms, hexagonal prisms, heptagonal prisms or octagonal prisms. Optionally, the thigh member and lower leg member may be semi-circular prisms (i.e. hemi-cylinders). Preferably, the thigh member and lower leg members may be cylindrical. The thigh member is preferably a truncated cylinder in which one end of the cylinder is perpendicular to its longitudinal axis and the other end of the cylinder is disposed at an angle to the perpendicular of the longitudinal axis, which may define a first end of the thigh member.

Preferably, a thigh member has a width of from 10 to 40 cm, preferably 10 to 30 cm. Preferably a thigh member has maximum length (along its longitudinal dimension) of height of from 20 to 60 cm.

Preferably a lower leg member has a width of from 10 to 40 cm, preferably 10 to 30 cm. Preferably, a lower leg member has a maximum length (along its longitudinal dimension) or height of from 20 to 60 cm.

Preferably, the thigh member is longer than the lower leg member. Preferably, the thigh member is wider than the lower leg member.

Preferably, the thigh members are disposed in relation to the body member such that their longitudinal axes are separated from one another by at least 1.25 thigh widths, more preferably up to 4 thigh widths, more preferably in the range 1.4 to 3 thigh widths, such as 1.5 to 2 thigh widths.

The height of the apparatus may be in the range from 50 to 175 cm, preferably to 150 cm and more preferably to 125 cm.

In one embodiment, an apparatus for use by adults comprises a height of from 100 to 120 cm, a pelvis body member having a width of 40 to 55 cm and eight of 25 to 35 cm and a depth of from 20 to 30 cm, a thigh member having a width of from 15 to 25 cm and height of from 35 to 45 cm, and a lower leg member having a width of from 10 to 20 cm and height of from 35 to 45 cm.

Preferably, the lower leg member is arranged in relation to the thigh member extend from and to be resiliently movable relative to and/or separable from the thigh member, preferably by way of an elastic material such as an elastic band or bungee extending between and preferably through the cooperating surfaces and into the thigh and lower leg members.

Preferably, the leg member comprises a first end which is a first angled end configure for abutting a corresponding angled leg-contacting surface on the body member.

In one preferred embodiment, the apparatus comprises a body member (e.g. pelvis body member), two thigh members, two lower leg members and a biasing elastic band or bungee.

In an alternative embodiment, the apparatus further comprises ankle members, which are preferably of a similar shape to the lower leg members and preferably have dimensions of 15 to 30 cm in height and 10 to 30 cm in width. Optionally, further members (e.g. feet) may be provided where further stability is required.

The members may be formed of any suitable material.

In one embodiment, the members comprise a shaped cover (e.g. of leather or synthetic leather, such as PVC, or textile or fabric, as is known in the art) filled with an appropriate filler (e.g. fibrous filler, fabrics, wool, reconstituted foam or shaped foamed plastic filler). Alternatively, the members may be for example a shaped pad of resilient or resiliently compressible foam material (e.g. polyurethane) coated with a synthetic coating material or a cover (of, e.g. leather or synthetic leather, such as PVC, or textile or fabric, as is known in the art). The coating material may be a laminate such as a woven or textile fabric with a PVC coating.

Preferably, one or more of the body member, leg members, thigh members, lower leg members and ankle members are formed of a foam material. Preferably, the foam material is a medium foam, high firm foam or severe high firm foam. Preferably, the foam is a recon foam, e.g. from 5 to 10 lb, preferably a 6 lb or a 9 lb recon foam.

Optionally, two or more of the body member, leg members, thigh members, lower leg members or ankle members are mobile or moveable relative to one another within a flexible outer coating or flexible case.

Preferably, two or more of the body member, leg members, thigh members, lower leg members or ankle members are provided with an individual outer coating or cover to form a discrete coated foam member. Preferably each and all of the body member, thigh members and lower leg members are provided with an individual outer coating or cover to form a discrete coated foam member.

Preferably, the covers are PVC covers.

Optionally, the pelvis body member, a thigh member and/or a lower leg member have gripping features, which may be disposed on the surface or within the surface (permanently or removably). Preferably, the members are absent any readily gripable features or protrusions.

One or both of the two padded elongate leg members may optionally comprise one or more of:

A) a movable guiding flange member disposed about the surface thereof which is capable of being moved to multiple longitudinal positions along the length of the one or more leg members;

B) an elongate enclosed cavity within the one or more leg members, which cavity contains or may contain a mobile material occupying a portion of the cavity; and C) an interchangeable core, core assembly or internal layer of the one or more leg members whereby the elongate member is configured such that one or more core elements or internal layers may be removed from the elongate member and substituted with alternative core elements or internal layers having alternative features.

In one embodiment, an apparatus according to the present invention may comprise a movable guiding flange member disposed about the surface of a leg or part thereof, which is capable of being moved to multiple longitudinal positions along the length of the elongate contact pad. The guiding flange may be of any suitable size to fit about the circumference of the leg or part thereof at various points along its length so as to define a target tackling zone (e.g. a low target tackling area, a medial target tackling area or a high target tackling area). When fitted to the apparatus, the guiding flange should preferably rest in selected position without support, so that it can be positioned and then used at that position in training.

Preferably, the guiding flange, in use, should project outwards from the front and preferably side surfaces of the leg to an extent to define a tackle area such that in use it is apparent if the target area has not been properly targeted. Preferably, it projects outward from the or each respective surface of the elongate contact pad by from 5 to 30 cm, more preferably at least 8 cm, e.g. from 10 to 25 cm. In one embodiment, it may project outward by at least 15 cm, and most preferably about 20 cm. In another more preferred embodiment, it projects outwards by up to 15 cm, say 11 to 13 cm and preferably about 12 cm.

The guiding flange may have any suitable length (i.e. extent along a longitudinal direction defined by the elongate contact pad of the apparatus), but is preferably at least 3 cm, more preferably at least 5 cm and up to 20 cm, more preferably 5 to 15 cm, more preferably 7 to 11 cm e.g. about 8 cm or about 10 cm.

The guiding flange may remain in a position on the leg by, for example, being a snug fit to the leg or by way of fixings such as snap fit fixings or hook and loop fixing (e.g. hook and loop fastener commonly known as VELCRO).

In a one embodiment the apparatus comprises a core assembly which may be adapted to alter the properties or behaviour of the apparatus. Optionally, the core assembly may be removable and interchangeable to facilitate a range of weights or dynamic or other properties. The inter-changeable core assembly may comprise one interchangeable core component or a plurality of interchangeable core components (e.g. a central longitudinal core and one or more inner layers).

An interchangeable core component or central core may comprise or be interchanged with a foam core member (which is typically a cylindrical member)

In an embodiment where a core assembly comprises a central core and one or more concentric or coaxial tubular or inner layers, each may be interchanged with other core or tubular members or together may interchanged with a larger component (such as a large foam core or a container defining a cavity) so as to achieve desired properties.

In one embodiment, the apparatus comprises an elongate enclosed cavity within the one or more members, which cavity contains or may contain a mobile material occupying a portion of the cavity. Preferably the elongate member is the thigh member. The elongate enclosed cavity is preferably a sealed internal container, but may be an openable container. The mobile material may be any suitable material capable of moving when the device is tipped or an equivalent change in force is applied. The mobile material may be, for example, a single solid form (e.g. a disc or multiple discs on a rod, or a large ball) or may comprise multiple parts (e.g. marbles) or may be particulate in nature (e.g. sand) or may be a liquid (e.g. water). Optionally, the mobile material is a weight formed on a rod fixedly mounted in the elongate cavity whereby the weight may move along the rod when the apparatus is tipped or other appropriate change in force is applied. Alternatively, the mobile material is sand or other suitable particular material or water (or other non-viscous liquid) which may move along the internal cavity. Preferably, the mobile material is a flowable solid, such as sand. In use, the apparatus of this embodiment may be provided in an upright (i.e. elongate direction upwards) configuration and the user may attempt to 'tackle' the apparatus as if it is another player bringing it to ground in a manner whereby the apparatus is tipped so as to be grounded in a substantially horizontally extended position. During the change in force applied to the apparatus during the 'tackle' or collision, by virtue of tipping and striking the apparatus an equivalent force is applied to the mobile material within the internal cavity. As the player brings the apparatus to rest on the ground, the mobile material is typically caused to continue to move in the direction of the force, which is typically after a tackle along the length of the internal cavity and as it strikes the other end of the internal cavity, the mobile material applies a corresponding force (a supplemental force) to the padded member surrounding it causing it to move further in the direction of the original 'tackle' or collision (a supplemental movement). This makes holding the apparatus during and after the 'tackle' more difficult and somewhat mimics the struggle and effort of a tackled player during the game of American football or rugby. Thus, the apparatus may be useful in training for improved holding technique, or wrapping, and holding strength during and after tackle.

Optionally the amount or weight of mobile material may be variable or adjustable by providing access to open the internal cavity, whereby the power of the supplemental force and quantum of supplemental movement may be varied as desired.

In a further embodiment, applicable to the invention and all the embodiments hereinbefore described, a training apparatus may be further provided with a sensor or arrangement of sensors for measuring, analyzing and/or monitoring technique, performance and/or improvement over time.

According to this embodiment, there may be provided sensors at one or various locations about the contact surface of the apparatus, whereby point of contact may be determined, as well as possible additional data relating to duration of contact and strength of contact. Sensors may be provided on the elongate contact pad and the two laterally disposed elongate members in particular to record where contact occurs and also where the wrap and grip takes place and optionally strength and duration of wrap and grip. Optionally, the apparatus is provided with a sensor or device for determining one or more of distance, speed and direction of movement of the apparatus (e.g. accelerometer, gyrometer and/or GPS sensor). Typically, the data generated by the sensor(s) will be transmitted by wireless communication via a receiver to e.g. a microprocessor. The data may then be analyzed (e.g. by a software application) to determine factors of performance about the particular user, such as accuracy of hit and power within the initial hit, whether the power was maintained or fell away after initial impact, the strength that was demonstrated and the distance, speed and direction in which the apparatus was moved. Thus the strengths and weaknesses of a particular player's technique can be measured and, for example, a profile created. Thus exercises to improve on weaknesses can be identified, such as through identifying changes that would improve the particular player's technique as well as strength and conditioning programmes to improve the player's performance.

Optionally, the user may have items of clothing, a shirt and headwear for example, configured with sensors to define the points of contact with the apparatus and also the orientation of particular body parts in the approach, during and after contact with apparatus. The apparel sensor data may be combined with the sensor data from the apparatus to give a unique informative data set on both the points of contact on the apparatus but also the points of contact by the user as well as orientation, direction and strength data.

Optionally, the data generated may be configured for graphical representation on a video or animated representation of a user carrying out a tackle in training on the apparatus to illustrate how changes in body shape, approach and technique may improve the tackle. Optionally, the data can be used to simulate tackles in game play to provide predictive outcomes in gameplay from improvements in aspects of the tackle.

Optionally, there may be further sensors (or electronics) to determine the movement achieved.

Analysis can be used to determine improvements in training methods (e.g. to learn about the most efficient techniques and adapt training methods to accommodate them) as well as to adapt coaching on technique to meet a particular player's strengths and weaknesses thus maximizing each individual's potential. Further, methods may be developed for a particular team profile (collection of individual profiles) which may inform the most effective order and timing for joining a collision event or tackle.

Sensors, typically pressure sensors, capable of determining applied pressure as well as, preferably, extent and duration of applied pressure should preferably be placed beneath the surface of the contact surface. Optionally, a multi-cell sensor element may be provided that covers a substantial portion and preferably the entire contact surface may be used and pressure data transmitted to a receiving device (e.g. a microprocessor) typically by wireless communication, where the data is analyzed and presented back as output for immediate consumption by the user and/or the coach, e.g. in the form of number, graphs, charts or other visuals to illustrate the performance.

There is thus provided as a further aspect of the invention a training apparatus as described above, characterized in that one or more contact surface is configured with one or a plurality of sensors for determining the location, degree and extent of the contact with the contact surface. The location is preferably identified as one or a plurality of portions of the contact surface. By the degree of contact it is meant the strength of contact and by extent of contact it is meant duration (or plot of degree of contact over time). Optionally, the apparatus is provided with one or more sensors to determine the amount and direction of longitudinal and non-longitudinal movement of the apparatus during a tackle or tackle event (from which may be produced, e.g., a plot of position against time). Preferably, the apparatus has one or more further features as hereinbefore described.

In a further aspect, there is provided a program for a computer configured to receive data from such sensors and according to a pre-determined format, provide an output (e.g. as a digital display).

Such data may be further utilized to monitor the improvement of a player over time and also the performance of a coach over time.

In a still further aspect of the invention, there is provided a method of training a person in improved tackle technique, the method comprising: providing a training apparatus as hereinbefore defined, the apparatus configured with one or a plurality of sensors appropriately calibrated for determining the location, degree and extent of the contact with the contact surface; providing a microprocessor in signal communication (e.g. by wireless communication) with the plurality of sensors and programmed to interpret and/or analyze the sensor data; conducting one or a series of contact events in which the person follows a training instruction to contact with a training apparatus; analyzing the data associated with the one or series of contact events generated by the sensors and communicated to the microprocessor; determining weaknesses in the player technique or conditioning level by comparison of sets of the data with pre-determined (or calibrated) sets of target data associated with one or more player techniques or conditioning levels; and producing a technique or conditioning training schedule comprising training elements selected from a pre-determined set of training elements designed to improve certain weaknesses in technique or conditioning level. The person may then undertake training according to the training schedule and then may repeat the method above. Thus a new set of collision event data may be generated which may be compared with existing data sets, such as pre-determined target data (to determine perceived weaknesses), the person's previous data (to determine improvement, over time and of the perceived weaknesses as a result of the targeted training) and team data.

The effectiveness of training method (or technique or conditioning schedules) and/or the effectiveness of the conditioning coach may be assessed by performance measurement. Further, the use of person data in the context of team data may be utilized to plan game play utilizing certain player strengths (e.g. the data may indicate that certain persons in a team are better at certain parts of the tackle event, whilst other persons are better at other parts of the tackle event), which is thus a further method of the invention.

Sets of technique and performance data for persons and teams may be obtained and categorized according to a training exercise. These datasets, which are preferably tagged with surface condition data (e.g. if the ground is in a similar condition) may be used to assess improvement in individual and team technique, performance and conditioning, to assess effectiveness of training or conditioning (and training and conditioning coaches) and to plan most advantageous game play for a team.

The invention will now be described in more detail, without limitation, with reference to the accompanying Figures.

In FIG. 1, a tackle training apparatus 1 according to one embodiment for use in training of the tackle comprises a pelvis body member 3 having a pentagonal shaped front face 27. The pelvis body member 3 is supported above the ground by two elongate leg members 5 each having a first end 13 which abut an angled leg-contacting surface 29 (defining an angle to the horizontal, e.g. when the apparatus is disposed in an upright or 'standing' position, of 30-45°) of the pelvis body member 3 and a second end 15 resting on the ground 25. Each elongate leg member 5 comprises an oblique truncated cylindrical thigh member 7 having a first angled end 13 (defining an angle to a transvers plane of the cylindrical member of 30-45°) for abutting the corresponding angled leg-contacting surface 29 of the pelvis body member 3 and a second normal end 17. The second normal end 17 is configured to abut a first normal end 21 (shown in FIG. 2) of a cylindrical lower leg member 9 which itself has a second distal normal end abutting a top face of an ankle or foot member 11. The cylindrical lower leg member 9 has a smaller diameter than thigh member 7.

As illustrated in FIG. 1, when the ankle or foot members 11 are placed on the ground 25, the leg members 5 are capable of supporting the pelvis member 3 without further support and without falling down.

Figure 2:
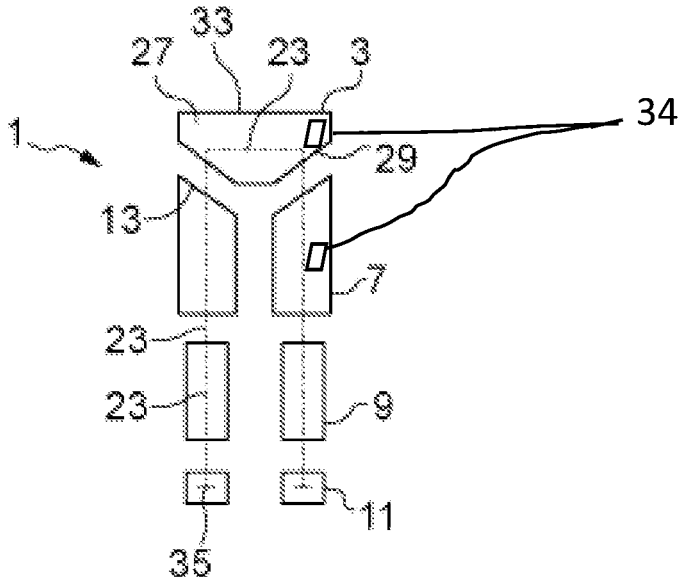
FIG. 2 illustrates an exploded view from a front of an apparatus of one embodiment of the invention.
Figure 3:
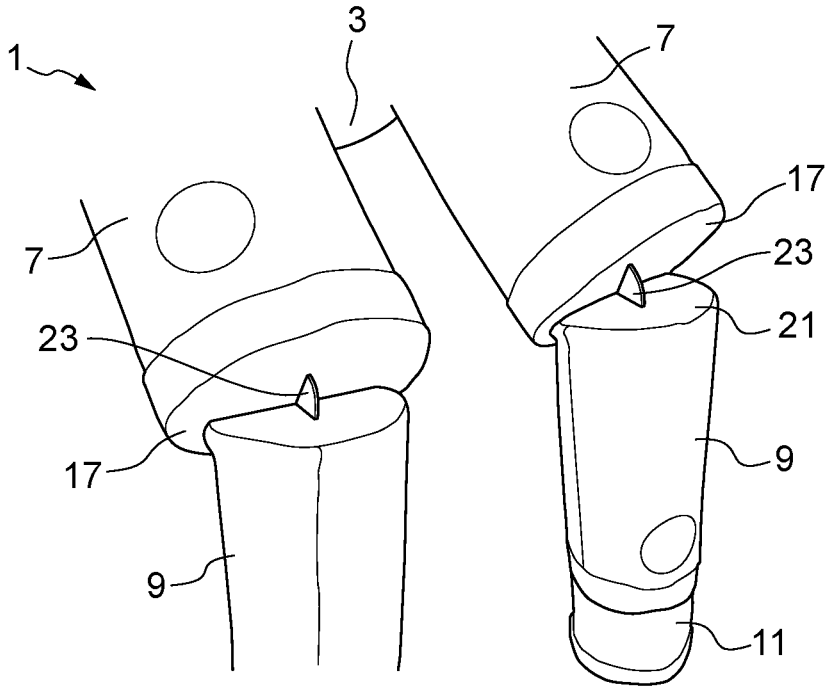
FIG. 3 illustrates in a close up view of a portion of the tackle training apparatus of FIG. 1 in an alternative configuration.

The pelvis body member 3, thigh members 7, lower leg members 9 and ankle members 11 are biased to their resting positions, e.g. in an upright configuration when placed in that position, by an elasticated member 23 such as a bungee or elastic band or similar that extends through the members. The bungee 23 may be anchored with an anchor 35 at an ankle member 11, extend through the interior of the lower leg member 9 from an ankle member 11 where it is anchored, extend from an end facing surface of a first normal end 21 of a lower leg member 9 through the corresponding facing surface of the second normal end 17 of thigh member 7, through the interior of thigh member 7, across the abutting surface of the first angled end 13 of the thigh member 7 and the angled leg-contacting surface 29 of the pelvis body member 3 and into the interior of the pelvis body member. The bungee may be anchored in the pelvis body member 3 but preferably extends through the body member 3, out the other leg-contacting surface 29 and through the opposing leg member 5 in a similar manner, as is illustrated in FIG. 2. One or a plurality of sensors 34 appropriately calibrated for determining the location, degree and extent of the contact with the contact surface are provide in some inventive embodiments. The elasticated member 23 serves to bias the members 3, 7, 9 and 11 toward one another and in particular toward their respective cooperating surfaces (that the bungee passes through). In resting position without application of external forces and where the members 3, 7, 9 and 11 are allowed to abut one another at their cooperating surfaces, the members 3, 7, 9 and 11 will rest or remain in contact with one another at their cooperating surface. The elasticated member also serves to ensure that the thigh member 7 and the pelvis body member 3 remain in contact between the angled leg-contacting surface 29 of the pelvis body member 3 and the angled first end 13 of the thigh member 7 to form an angled contact plane 31. It also enables the thigh member 7 and the pelvis body member 3 to remain in cooperation (and not slide away from one another) when the apparatus is in a standing position. The effect of the cooperation of thigh member 7 and pelvis body member 3 at angled contact plane 31 and the elastic member 23 is the formation of a form of hip joint. Thus, a thigh member 7 (and also a leg member 5) may be moveable back and forward relative to the pelvis body member 3 about an axis perpendicular to the angled contact plane 31, which movement can happen in tackle training mimicking a movement of limbs in a tackle in rugby or other contact sport. The lower leg member 9 and thigh member 7 may also rotate about an axis of their respective cooperating surfaces at ends 17, 21 which is also preferably the longitudinal axes of cylindrical members 7 and 9.

In FIG. 2, the apparatus 1 is shown with the thigh members 7 extending from pelvis member 3 and tilted at an angle to lower leg members 9 to expose the cooperating second end 17 of thigh member 7 and first end 21 of lower leg member 9. Thus, a further movement allows the thigh member 7 to tilt out of planar cooperation with pelvis body member 3 and allows the lower leg member 9 to tilt out of planar cooperation with the thigh member 7 as shown. This exposes elasticated member or bungee 23 which extends through the contact surfaces 17, 21. The bungee 23 biases the members 7 and 9 into cooperated planar or longitudinal axis cooperation.

The pelvis body member 3 is preferably in the form of a rotated pentagonal prism in which the end of the prism forms pentagonal front face 27. The pelvis body member preferably has a pelvis top surface 33 extending the full lateral extent (or most of the lateral extent) of the pelvis body member and is preferably flat (e.g. horizontal when the apparatus is in a standing position. A handle 19 may be provided on the top surface 33 of the pelvis body member 3.

The leg members 5 extend from generally below the pelvis body member 3 (or from the side) and are preferably generally laterally disposed on the pelvis body member. Ideally, the thigh members 3 are disposed on the pelvis body member 3 with a separation from one another of about half a thigh width diameter (e.g. the separation between the outer side surfaces of thigh members 7 or separated from longitudinal axis to longitudinal axis of thigh members 7 by one and a half thigh diameters).

In use, a player may carry out training exercises using the apparatus 1, e.g. by tackling and different heights, with different head positions. The apparatus 1 provides some instability and unpredictability in movement of members 7, 9, 11 mimicking the unpredictable movement of limbs and limb portions in a real tackle thus enabling the player's skill to be honed in reacting to movements, retaining grip of an unpredictable member, developing technique to manage this unpredictable movement in the tackle and secure the tackle effectively in a non-contact and safe engagement.

The invention has been described with reference to a preferred embodiment. However, it will be appreciated that variations and modifications can be effected by a person of ordinary skill in the art without departing from the scope of the invention.

The invention claimed is:

1. A tackle training apparatus comprising:

a padded body member defining a planar leg-contacting surface; and two padded elongate leg members, each leg member of the two padded elongate leg members having a first end for abutting the body member and a second end for contacting the ground, each leg member having thigh member defining the first end with a planar thigh member surface for cooperation with the leg-contacting surface of the padded body member, such that when in a standing position, each leg member is capable of moving back and fore relative to the body member about an axis perpendicular to the contact between the thigh member surface and the leg-contacting surface, thus defining a hip joint, each of the two leg members also defining a lower leg member, wherein the two padded elongate leg members are arranged in relation to the body member to extend from and to be resiliently movable relative to and separable from the padded body member, wherein the apparatus comprises an elasticated member for biasing the first end of each leg member of the two padded elongate leg members toward intimate contact with the padded body member, the elasticated member comprising an elastic material linking the first end of each leg member to the padded body member and wherein in one configuration where the second end of each of the two padded elongate leg members is placed on the ground, the two padded elongate leg members can support the padded body member such that the apparatus is in a standing position, wherein the padded body member and the two leg members are formed of a resiliently compressible foam material and have protective coating materials or covers.

2. The apparatus according to claim 1, wherein the elastic material extends through at least a portion of one of the leg members of the two padded elongate leg members and is anchored to the one of leg members.

3. The apparatus according to claim 1, wherein the thigh member is a truncated cylinder.

4. The apparatus according to claim 1, wherein the lower leg member is a cylinder.

5. The apparatus according to claim 1, wherein the lower leg member is arranged in relation to the thigh member to extend from and to be resiliently movable relative to and/or separable from the thigh member, and wherein in one configuration each lower leg member can support each thigh member such that the apparatus remains in the standing position.

6. The apparatus according to claim 1, wherein the padded body member is a pelvis simulating body member.

7. The apparatus according to claim 1, wherein one or both of the two padded elongate leg members comprises one or more of:

A) a movable guiding flange member disposed about the leg-contacting surface thereof which is capable of being moved to multiple longitudinal positions along the length of one or both of the two padded elongate leg members;

B) an elongate enclosed cavity formed within one or both of the two padded elongate leg members, which cavity contains or may contain a mobile material occupying a portion of the cavity; and C) an interchangeable core, core assembly or internal layer of one or both of the two padded elongate leg members whereby at least one of the two padded elongate leg members is configured such that one or more core elements or internal layers may be removed from the leg member and substituted with alternative core elements or internal layers having alternative features.

8. The apparatus according to claim 1, wherein two or more of the padded body member, the thigh member or the lower leg member are mobile or moveable relative to one another within a flexible outer coating or flexible case.

9. The apparatus according to claim 1, wherein two or more of the padded body member, the thigh member or the lower leg member are provided with an individual outer coating or cover to form a discrete coated foam member.

10. The apparatus according to claim 9, wherein each of the padded body member, the thigh member or the lower leg member are provided with an individual outer coating or cover to form a discrete coated foam member.

11. The apparatus according to claim 1, wherein the padded body member has a width of from 40 to 55 cm, and a depth of from 15 to 30 cm.

12. The apparatus according to claim 1, wherein the padded body member is a pelvis body member comprising a cube, cuboid or prism having a flat top surface extending the full lateral extent of the pelvis body member on which is disposed a handle.

13. The apparatus according to claim 1 on the surface of which is provided sensors for determining point of contact, duration of contact and strength of contact.

14. The apparatus according to claim 1, wherein the thigh member surface is disposed at an angle to the 25 to 45° relative to the leg-contacting surface of the padded body member.

15. A tackle training apparatus comprising a single pelvis body member, two thigh members, two lower leg members and a biasing elastic band or bungee, wherein each of the two thigh members have a first end for abutting the body member and a second end abutting a lower leg member and each lower leg member has a first end for abutting the second end of the thigh member and a second end for contacting the ground, wherein the two thigh members are arranged in relation to the body member to extend from and to be resiliently movable relative to and separable from the body member, wherein the two lower leg members are arranged in relation to the thigh member to extend from and to be resiliently moveable relative to and separable from the thigh members wherein the biasing elastic band or bungee links the first end of each thigh member to the pelvis body member and wherein in one configuration where the second end of each of the two leg members is placed on the ground, the two leg members can support the body member such that the apparatus is in a standing position, wherein the body member, the two thigh members and the two lower leg members are each formed of a resiliently compressible foam material and have a protective coating material or cover.

16. The tackle training apparatus according to claim 15 further comprising a handle is disposed on the pelvis body member.

17. A method of tackle training comprising:

providing an apparatus according to claim 1 in an upright position relative to ground; and a user attempting to tackle the apparatus by tipping the apparatus into a horizontally extended position in contact with the ground to provide tackle training.

18. The method according to claim 17 further comprising generating data from at least one sensor in the apparatus and analyzing the data to determine factors of performance for the user attempting to tackle the apparatus.

19. The method according to claim 18 wherein the factors of performance include at least one of accuracy of hit and power within an initial hit of the apparatus by the user, whether the power was maintained or fell away after the initial hit, the strength that was demonstrated, or the distance, speed and direction in which the apparatus was moved.

20. The method according to claim 18 further comprising creating exercises or conditioning for the user based on the data.

* * * * *